US005573238A

United States Patent [19]

Aaron et al.

[11] Patent Number: 5,573,238

[45] Date of Patent: Nov. 12, 1996

[54] PORTABLE BALL RING

[76] Inventors: Jamie D. Aaron, Unit 1, 13 Shelton Drive, Athelstone, State of South Australia, Australia; Scott R. Loveday, 11 Yaralinda Court, Demancourt, State of South Australia, Australia

[21] Appl. No.: 426,138

[22] Filed: Apr. 21, 1995

[51] Int. Cl.[6] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| 3,025,058 | 3/1962 | Brumfield | 273/1.5 R |
| 3,722,886 | 3/1973 | Sinner | 273/1.5 R |
| 4,789,156 | 12/1988 | D'Annunzio | 273/1.5 R |
| 4,869,501 | 9/1989 | Anastasakis | 273/1.5 R |
| 4,946,163 | 8/1990 | Aakre et al. | 273/1.5 R |
| 5,149,086 | 9/1992 | Ziff | 273/1.5 R |
| 5,316,290 | 5/1994 | Parr et al. | 273/1.5 R |
| 5,402,999 | 4/1995 | Keehn, Sr. | 273/1.5 R |

FOREIGN PATENT DOCUMENTS

| | | | |
|---|---|---|---|
| 306083 | 6/1955 | Switzerland | 273/1.5 R |
| 1070012 | 5/1967 | United Kingdom | 273/1.5 R |

*Primary Examiner*—Paul E. Shapiro
*Attorney, Agent, or Firm*—Hardaway Law Firm P.A.

[57] ABSTRACT

A portable ball ring for sports such as basketball or netball for use with a vehicle has a main support frame and a secondary support frame. The main support frame is attached to the vehicle, usually the tow bar, and is supported by the secondary support frame. The portable ball ring can be folded and collapsed and still remain attached to the vehicle allowing it to be transported without having to be disassembled.

14 Claims, 9 Drawing Sheets

PORTABLE BALL RING

BACKGROUND OF THE INVENTION

This invention relates to portable basketball (or other ball sports) tings or goals that position and hold a ball hoop and net at a desirable height from ground level, which may be attached to a vehicle both during use and transportation.

The portable ring is adapted to be foldable and collapsible so as to be transportable by a vehicle without requiring disattachment from the said vehicle.

There are a number of prior art devices that teach a variety of portable self-supporting and collapsible frame structures used for basketball goals. The prior art devices also teach various adjustable backboards allowing the device to be used by people of varying heights/abilities.

In U.S. Pat. No. 4,789,156 there is disclosed a portable basketball goal for use on a pick-up truck that has an adjustable frame assembly which is corrected to and stabilised by a pick-up truck. The portable basketball goal can then be disassembled into individual modular unites and transported within the truck.

SUMMARY OF THE INVENTION

It is an object of this invention to provide a portable ball ring that can be attached to a vehicle.

It is a further object of the invention to provide a portable ball ring that is foldable and collapsible while still attached to the vehicle thereby allowing for its transportation without needing to De detached from the vehicle, At the same time it does not obstruct the drivers view or the essential areas at the rear of the vehicle such as tail lights and license plate.

It is yet a further object of the invention to provide a portable ball ring that is foldable and collapsible and adapted to be transportable while attached to the rear of a vehicle and that is further adapted to be attachable to a wall by a suitable bracket means.

Therefore in form of the invention though this need not be the only or indeed the broadest form there is proposed a portable ball ring used with a vehicle including a main support frame, a secondary support frame, said main support frame adapted to be attached to and extendable upwardly and outwardly from the vehicle, said secondary support frame providing ground engaging base support for the main support frame, a ball ring secured to the end of the main support frame, the portable ball ring characterised in that it is foldable and collapsible so as to allow it to be transported while still attached to the rear of the vehicle.

In preference the portable ball ring includes a backboard for the ball ring so that the ball ring is a basketball goal. in preference the main support frame is attached to the rear tow bar of the vehicle.

In preference the secondary support frame is extendable.

In preference the ball ring is rotatably attached to the main support frame by a bracket means.

In preference the basketball goal is rotatably attached to the main support frame.

In preference the main support frame includes at least one lower arm at least one extendable arm the at least one extendable arm slidably engaging the at least one lower arm to allow for the extension of the main support frame, the relative position of the at least one extendable arm to the at least one lower arm being secured by a locking means.

In preference the locking means is a pin engaging the at least one extendable arm and the at least one lower arm through co-axial apertures.

In preference the secondary support frame includes a horizontal extrusion to provide ground engaging base support for the main support frame.

In preference at least one strap is used to anchor the horizontal extrusion to the vehicle thus providing extra support.

In preference the secondary support frame includes a lower arm and an extendable arm, the extendable arm slidably engaging the lower arm to allow for the extension of the secondary support frame, the relative position of the lower arm to the extension arm being secured by a locking means.

In preference the portable ball ring further includes a net located between the ball ring and the vehicle to prevent a ball impacting on the vehicle.

In preference the main support frame includes a lower bar substantially perpendicular to the main support frame, the lower bar securably attachable to the tow bar by a clamp means.

In preference the lower bar includes several apertures which are adapted to be alignable with apertures in the tow bar when the portable ball ring is in its transportable mode.

In preference when in transportable mode the main support frame and the secondary support frame are substantially vertical to the ground plane and of minimum extension as allowed by the extendable arms slidably engaging the lower arms.

In preference the portable ball ring is adapted to be detachable from the vehicle and attachable to a wall or frame.

DESCRIPTION OF THE PREFERRED EMBODIMENT

Figure 1:
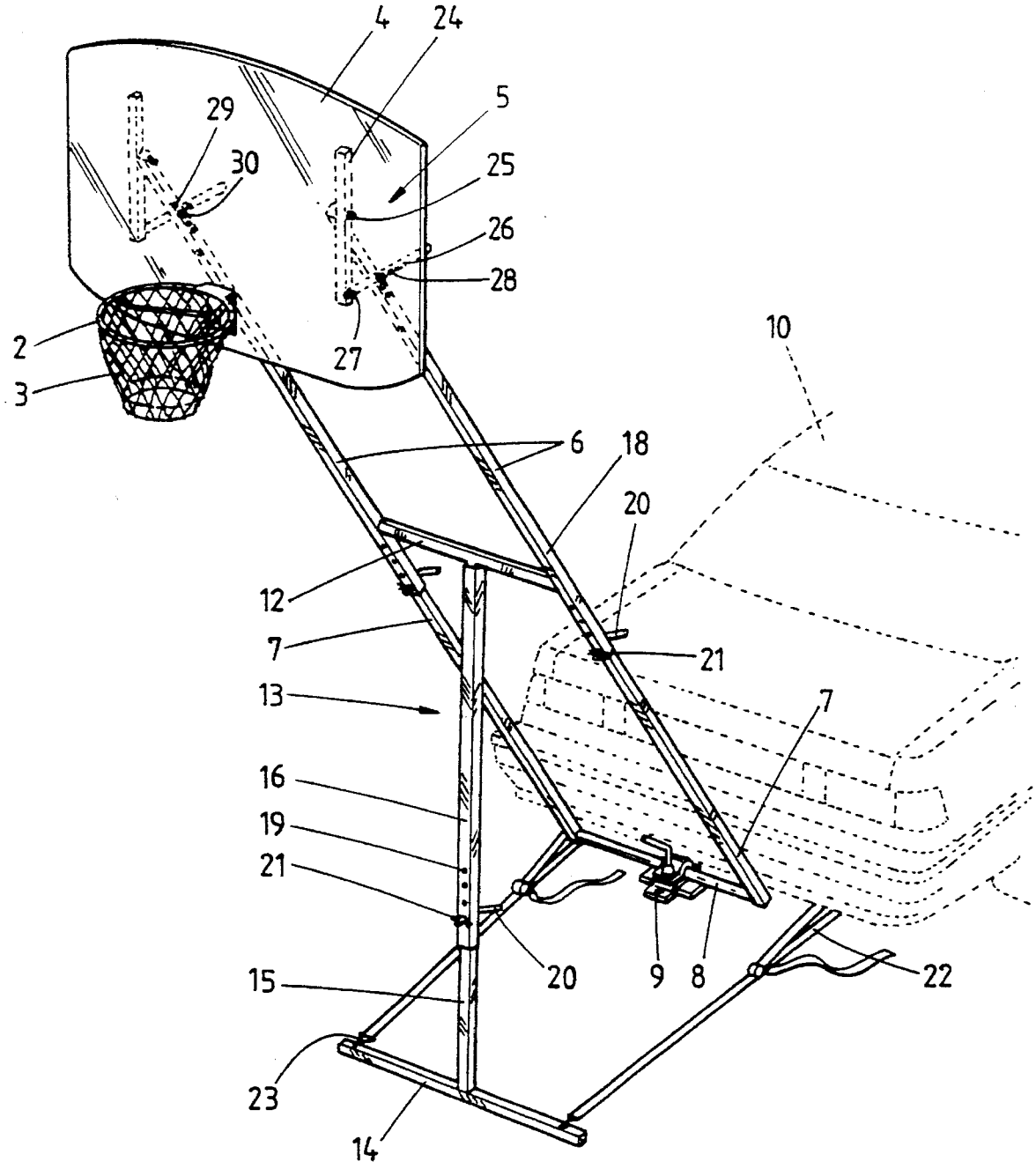
FIG 1 is a perspective view of the basketball ring fully extended and attached to a rear of a vehicle.
Figure 2:
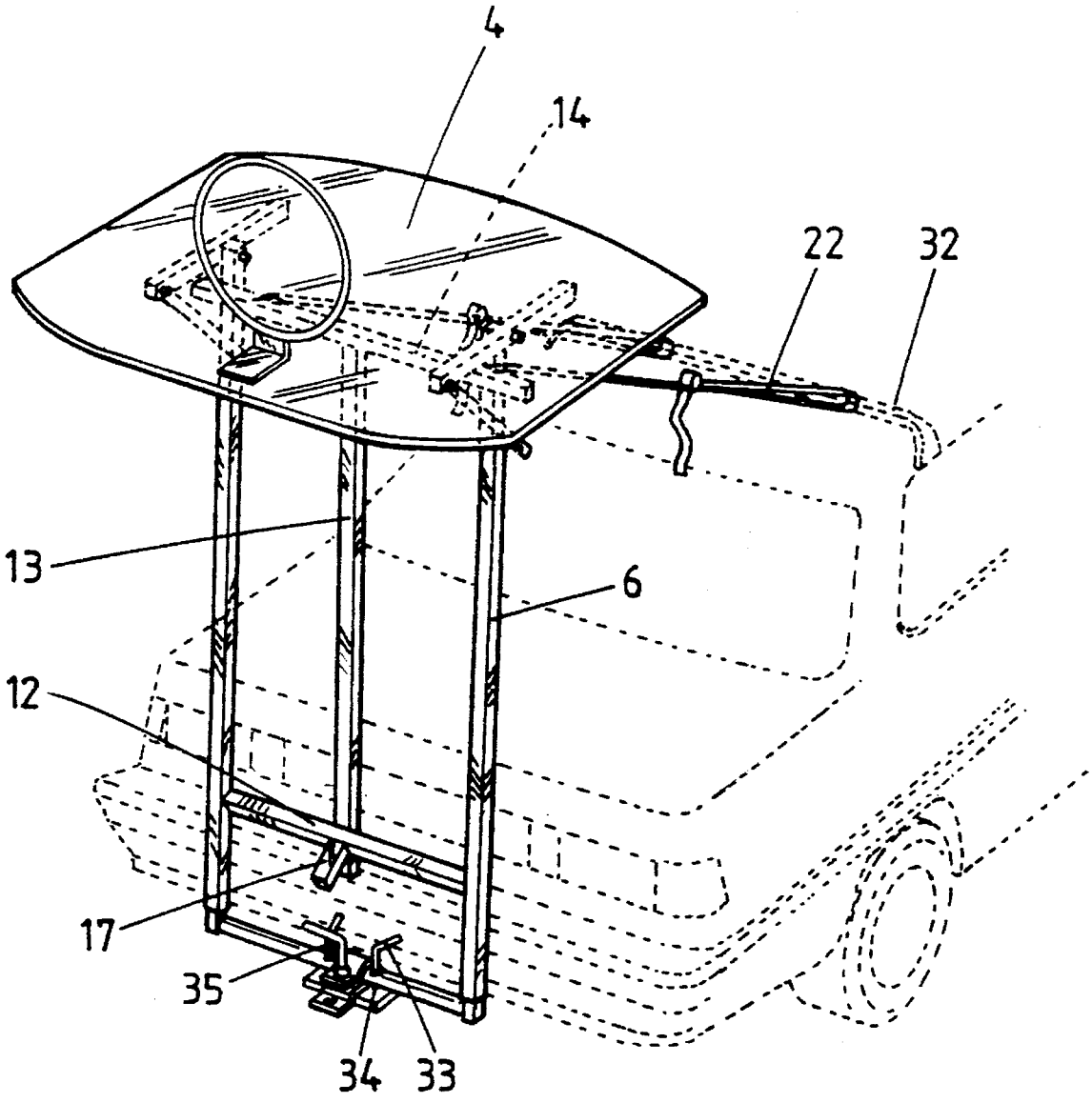
FIG. 2 is a perspective view of the basketball ring in its folded state ready for transportation.
Figure 3:
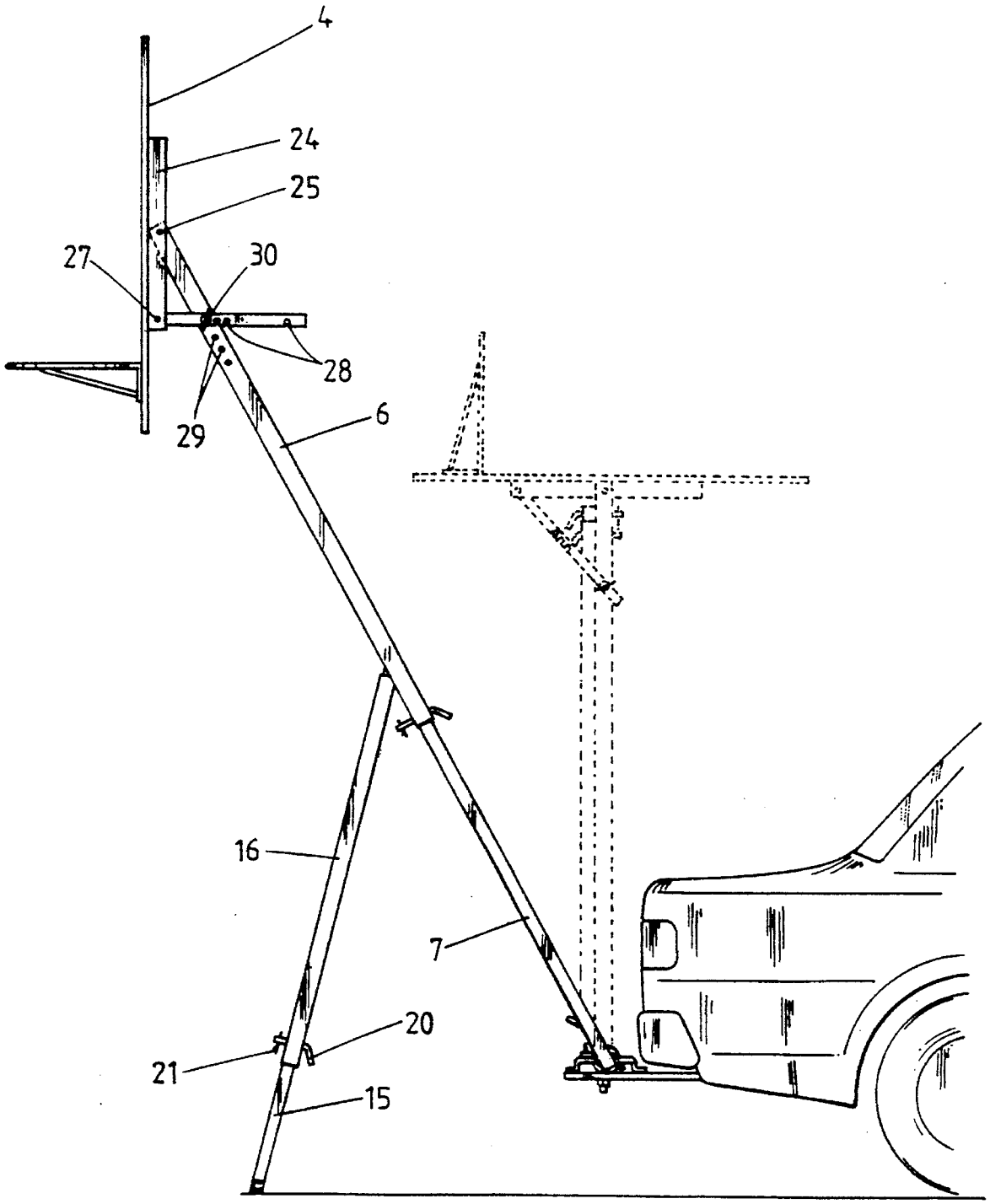
FIG. 3 is a side view of the basketball ring fully extended (solid lines) and folded (dashed lines)
Figure 4:
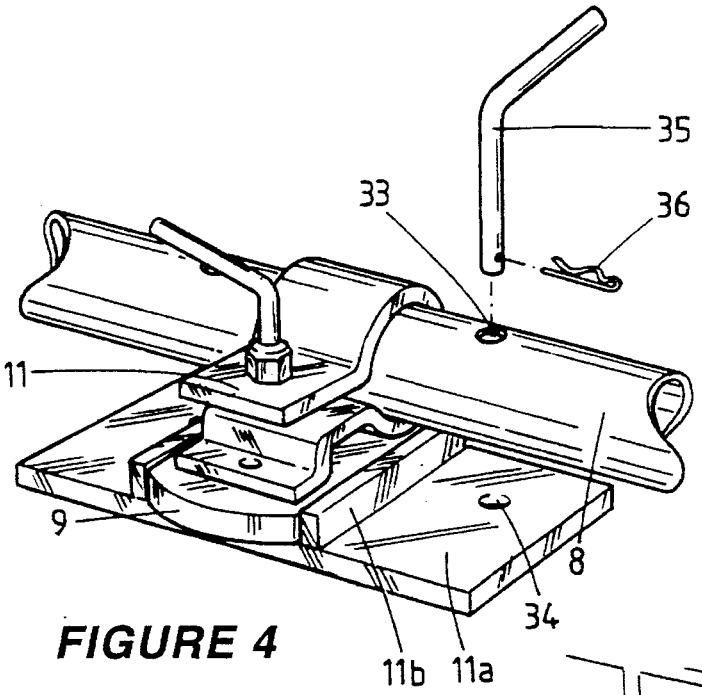
FIG. 4 is a perspective view of the bracket used to attach the portable ball ring to a tow bar of a vehicle.

Turning now to the drawings in detail them is shown in FIGS. 1, 2 and 3 a basketball goal 1 including a ring 2, net 3 and backboard 4.

The backboard 4 is swivably attached by bracket means 5 to extension arms 6 which are slidably attached to lower arms 7. The lower arms 7 are joined at their ends by a perpendicularly extending lower bar 8 which is attached to the tow bar 9 of a vehicle 10 by a suitable clamp 11.

The extension arms 6 are joined by a perpendicular cross bar 12 at their lower extremities, the crossbar 12 also adapted to engage a support member 13 comprising of a bottom bar 14 attached perpendicularly to the end of support arm 15 which is adapted to slidably engage support extension 16, the support extension 16 engaging crossbar 12 by a support adjoiner 17 which in this case is a perpendicular extension on the crossbar 12. The bottom bar 14 is placed on a firm supporting surface, normally the ground thus providing a stable point.

Since the support extension 16 slidably engages support arm 15, the extension arms 6 slidably engage lower arms 7 and the lower bar 8 can be rotated around its central axis within vehicle clamp 11 one can see that the height and position of the basketball ring can be varied. Once a position has been reached it is then necessary to lock it in place. This can be accomplished by any suitable means, such as frictional means, but in this embodiment the apparatus uses co-operating apertures which are used to allow for the insertion of pins. There may thus be apertures 18 along the extension arms 6 and lower arms 7, apertures 19 along the support arm 15 and support extension 16. When the desired relative position of the various arms and extensions is reached with the apertures being co-axial a pin 20 is inserted through the apertures thus locking the arms and extensions in place. The pins themselves may also be locked in place by a locking means such as a locking pin 21 adapted to be inserted through an aperture at the end of pin 20 thus preventing the pin from sliding out of apertures 18 and 19.

Whilst support arm 15 slidably engages crossbar 12 by sliding onto support adjoiner 17 and is kept there when the basketball ring is fully extended simply by gravitational forces a locking means (not shown) could also be used to secure it in place, such as a pin means acting through co-operating apertures.

The crossbar 12 may also be rotatably attached to the extension arms 6 so that this may allow for the relative position of the bottom bar 14 to be adjustable with respect to the vehicle 10. This is a useful feature if say there happens to be an obstacle or uneven ground in places.

When in its fully extended position (as shown in FIG. 1 ), the basketball ring may be further stabilised by adjustable straps 22 which may be attached from the extremities of bottom bar 14 by any suitable means to the rear of vehicle 10, In this embodiment the attachment to the bottom bar by the straps uses apertures 23 within bottom bar 14.

The tilt of the backboard 4 may also be adjustable with the bracket means 5 including board brackets 24 attached to the backboard 4 and extending vertically along the backboard. The extension arms 6 are swivably engaged to the board brackets 24 by a suitable means, in this case a bolt 25 passing through co-operating apertures in the extension arms 6 and board 13 rackets 24. To lock the backboard 4 relative to the extension arms 6 there are further adjusting bars 26 attached to the lower end of the board brackets 24 (lower in the sense when the backboard is substantially vertical) the adjusting bars 26 being swivabty attached by a further Dolt 27 engaging the adjusting bar 26 to the board bracket 24 by co-operating apertures. The adjusting bars have along their lengths further apertures or notches 28 which are co-axially aligned with apertures 29 in the extension arms when the backboard 4 desired tilt has been reached and are locked in that position by suitable means such as a pin or as shown in FIG. 1 a bolt 30. However since the adjusting bar 26 is rotatable wet the board bracket it may not be necessary to have more than one aperture 28.

It is to be understood that various bracket means may be employed. For example the board bracket may be a U-shaped channel (not shown) with bolt 25 rotatably holding extension arms 6 by passing through both sides of a U-shaped channel and through the extension arms located within the channel.

To transport the portable basketball ring 1, it is folded and collapsed, this shown in FIG. 2. This shows the backboard 4 tilted so that it is substantially vertical to the extension arms. This minimises air drag and prevents the board from being a traffic hazard. Furthermore, the extension arms 6 have been substantially slid along the lower arms 7 so as to minimise the vertical extent when in the folded position. The support member 13 has been detached from the crossbar and can be locked into the folded basketball ring by co-axially aligning apertures 23 with further apertures 31 in the extension arms and held there by a suitable means such as a locking pin (not shown ). In this case the apertures 31 are parallel to the board brackets 24.

Straps 22 can then be used to secure the folded portable basketball ring by attachment to any suitable points, such as the extension arms (as close to the board as practicable) and a roof rack 32 of the vehicle. Alternatively they may be attached to other secure points, such as the edge of the boot lid (not shown). To further secure the folded portable basketballs ring the lower bar 8 may have apertures 33 that are designed to co-axially align with suitable apertures 34 in tow bar 9. Bolts or pins 35 can then be used to thus further secure the lower bar to the tow bar of the vehicle. The pin 35 may itself be secured by pin 36. This embodiment is shown in RG 4. Prior to securement with the straps the axis of the apertures may be slightly tilted in a direction away from the vehicle. in this way, when the straps are used to secure further they tension against the pins thereby making the whole structure more stable for transportation.

In addition the vehicle clamp 11 may include a tow bar plate 11 a usually placed below the tow bar and including two opposite side walls 11 b extending upwardly from the tow bar so as to prevent any rotational movement with respect to the ground plane.

Alternatively the tow bar plate may be placed above the tow bar with the side walls projecting downwards (not shown) and surrounding the tow bar.

Thus one can see that this invention allows for a basketball ring to be assembled quickly and easily and yet allow for a hitherto unknown portability.

Figure 5:
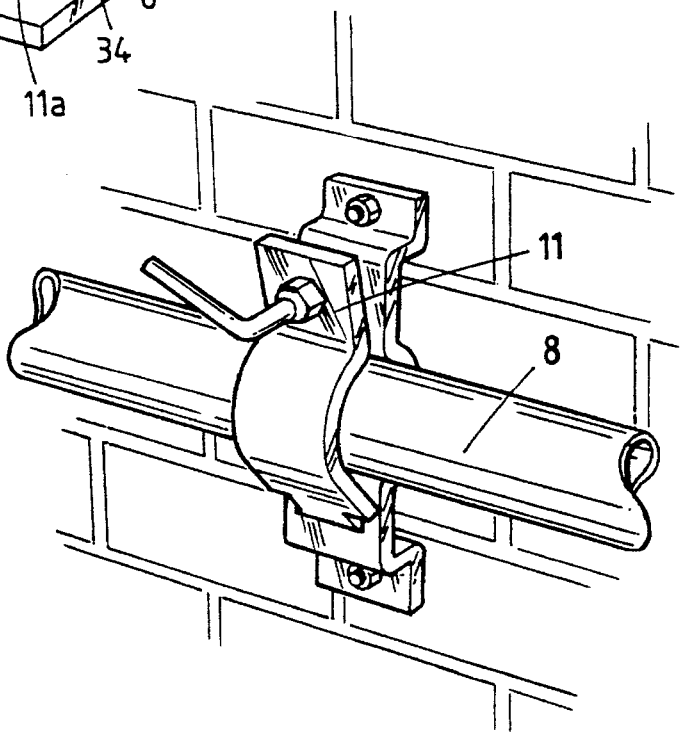
FIG. 5 is a perspective view of the bracket when used to attach to a wall.
Figure 6:
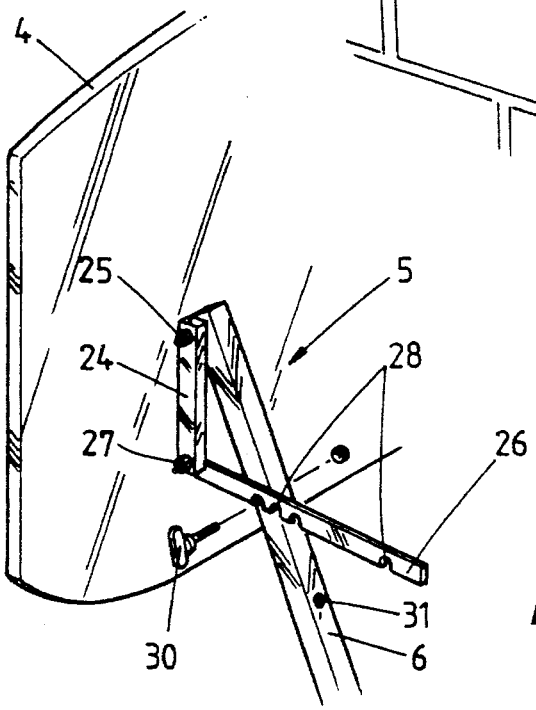
FIG. 6 is a view of the tilt adjustment of the backboard.
Figure 7:
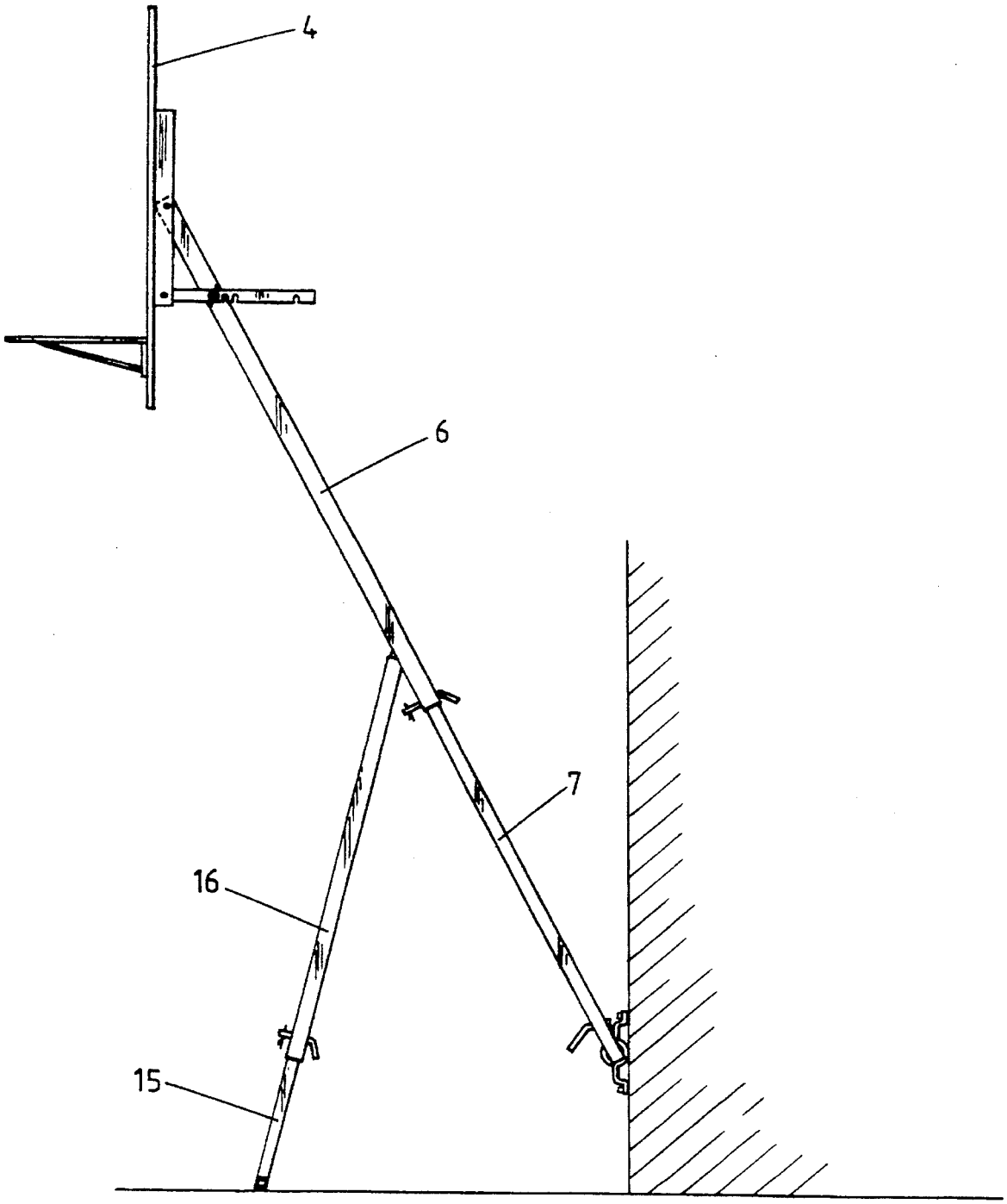
FIG. 7 is a side view of the basketball ring fully extended attached to a wall.

Furthermore, it allows for the portable basketball ring to be detached from a vehicle and attached to other suitable surfaces such as a wall (FIGS. 5 and 7) or a frame (not shown). This may be preferential at times, the invention still providing a ball ring to be transported easier than has been known to date without using valuable internal vehicle space and also thus minimising potential injury by remaining outside the vehicle.

It is to be understood that many embodiments of the invention may be carried out Without deviating from the spirit of the invention. Some of these am further discussed below, while others will be obvious to workers skilled in the art.

Basic engineering principles may be employed to further strengthen and simplify the invention. For example, cross-members may be used to adjoin the board brackets 4 while, struts may be used on the extension arms 6. There may also be a number of extension and lower arms acting in a telescopic arrangement. The invention may be further adapted to be attachable to any suitable part of a car such as the front bumper bar or the side foot panels on pick up trucks. The locking of the various arms in place can be done by a ratchet means whilst the extensions may be adjustable by gas strut means.

Figure 8:
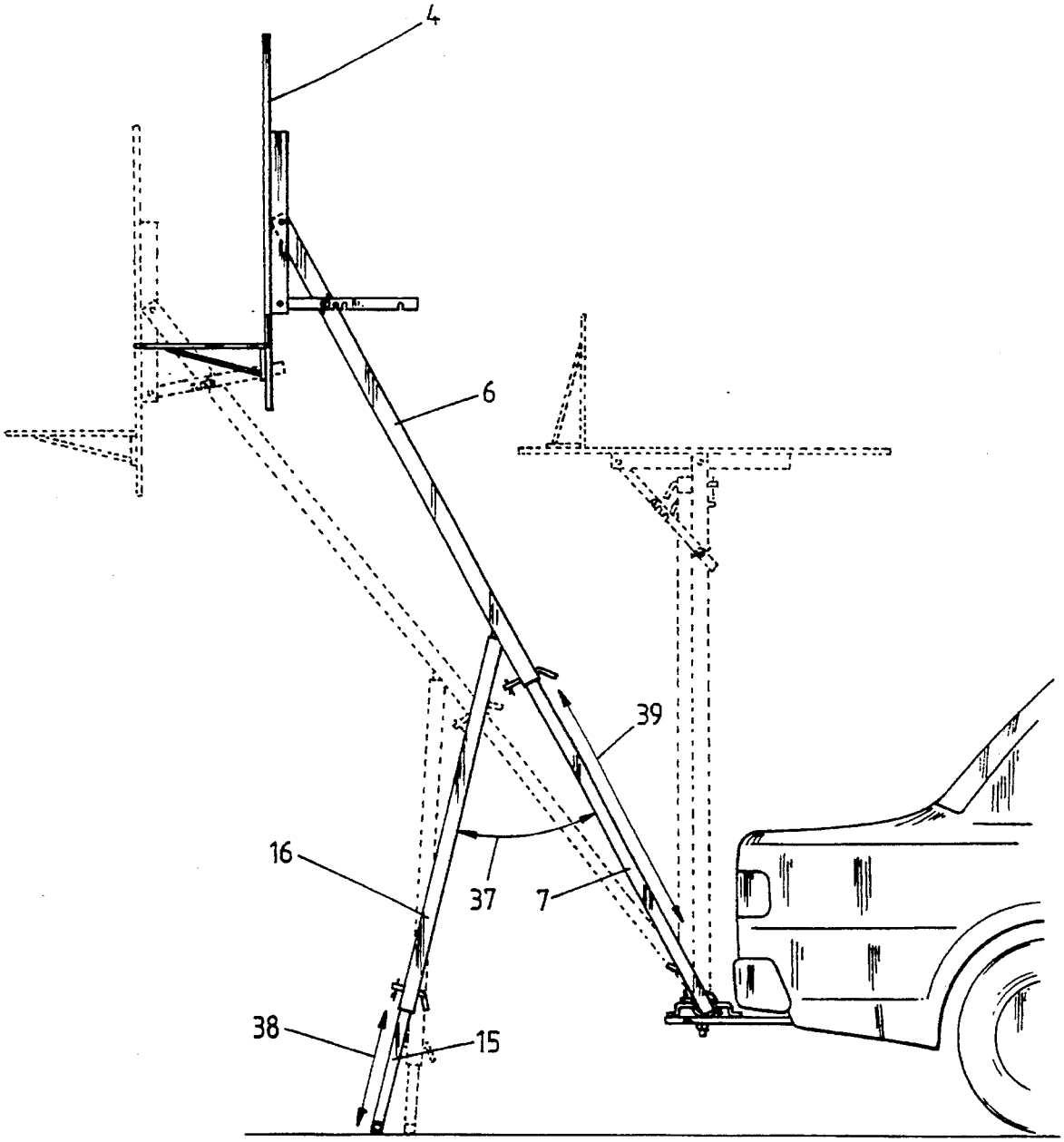
FIG. 8 is a side view of the basketball ring when adjusted for several different heights.

FIG. 8 shows the side view of the portable basketball ring showing not only how the height of the ring wet ground level can be varied, it also Shows the side view of the portable basketball ring in its folded position. The different height is simply achieved by varying the angle 37 in between the support extension 15 and the lower arms 7, by changing the relative extension 38 of the support extension 16 with respect to support arm 15 or by varying the relative extension 39 of the extension arms 6 with respect to lower arm 7, or a combination of the three. Of course after each height adjustment it may be necessary to adjust the it of the backboard to be as vertical as practicable when one wishes to play basketball. However, many other games may be played by having a specifically different tilt on the backboard, this only limited by ones imagination.

Figure 9:
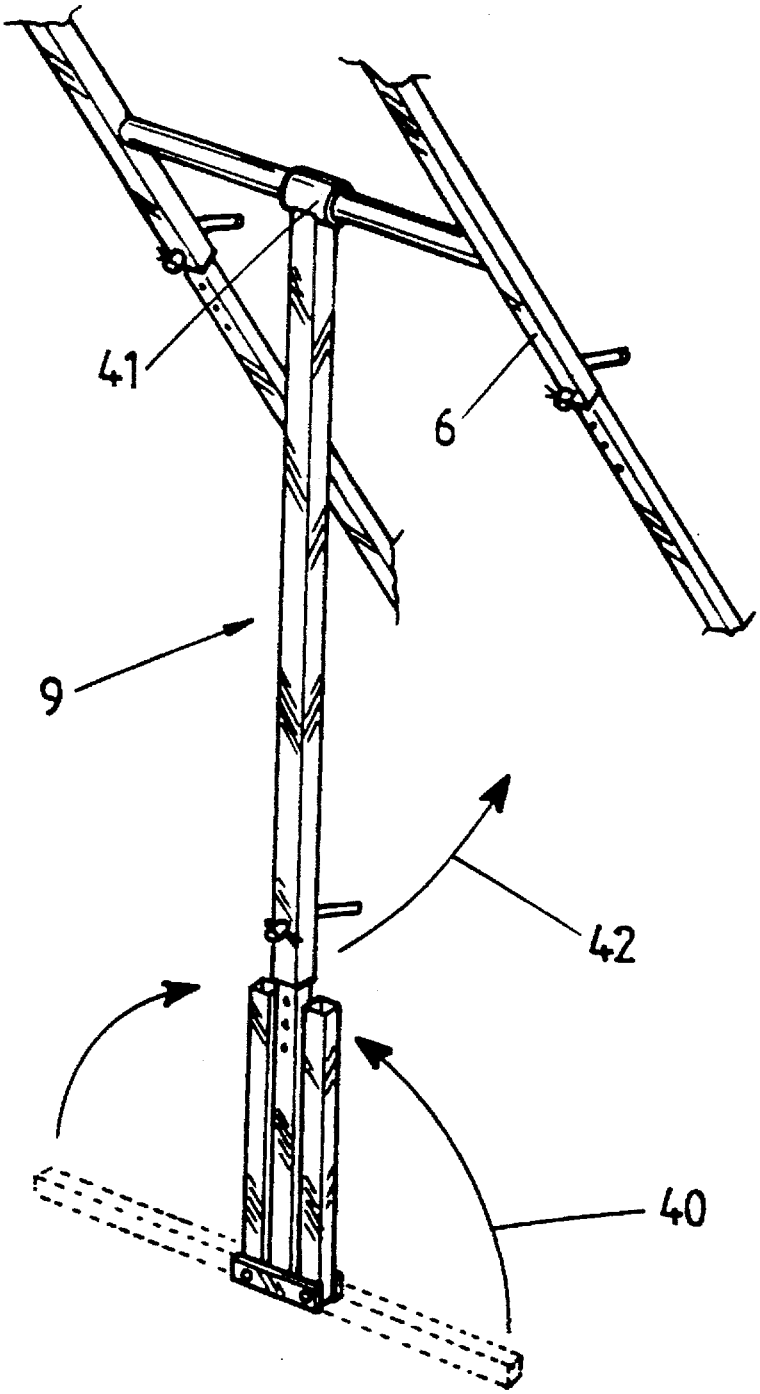
FIG. 9 is a perspective view showing another embodiment of folding the portable basketball ring for transportation.

Another embodiment is shown in FIG. 9 where the support member 9 has a foldable bottom bar 14 with the extremities of the bar folding in direction 40 towards the support extension 16. The support member is attached to the cross bar by a cylindrical sleeve 41 which allows the support member 13 to rotate through direction 42 so as to be substantially parallel to the extension arms 6. In this way unlike the embodiment shown in FIG. 2 the support member does not need to be detached from the crossbar for transportation. However, the foldable bottom bar will need to have a locking mechanism (not shown) so as to keep the bottom bar in an extended position.

Figure 10:
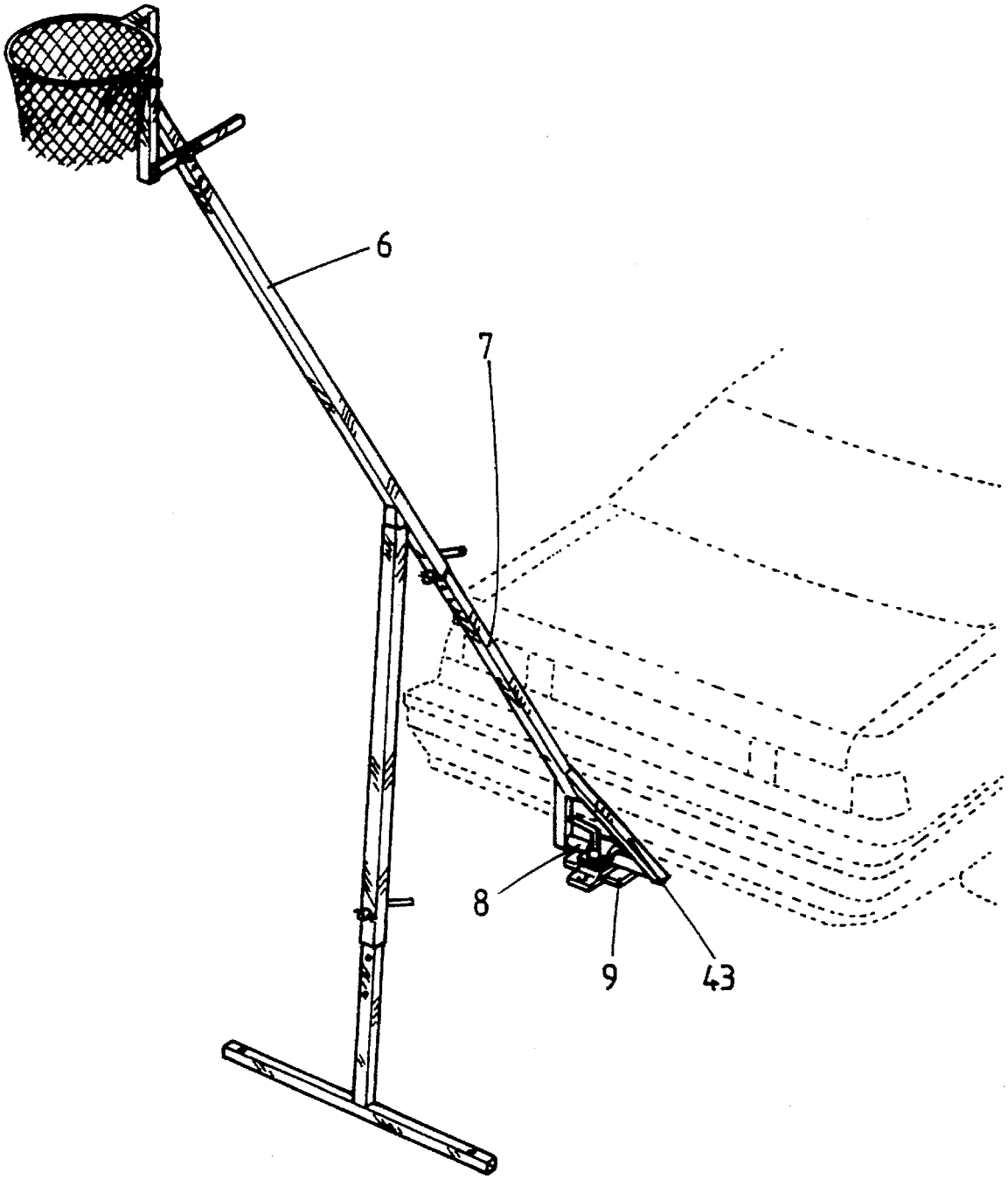
FIG. 10 is a perspective view showing the invention employed for a different ball game not requiring a backboard.

Whilst the above embodiments concentrated on a portable basketball ring, this invention can also be applied to other ball sports which require a ball hoop and/or net to be stably erected. An example of this invention can be seen in FIG. 10 when the invention is used for netball. This particular embodiment eliminates the need for a backboard, thus requiring only one extension and lower arm although the lower arm is now connected to a triangular support 43 so as to enable the lower bar 8 to be attached to the tow bar 9.

Figure 11:
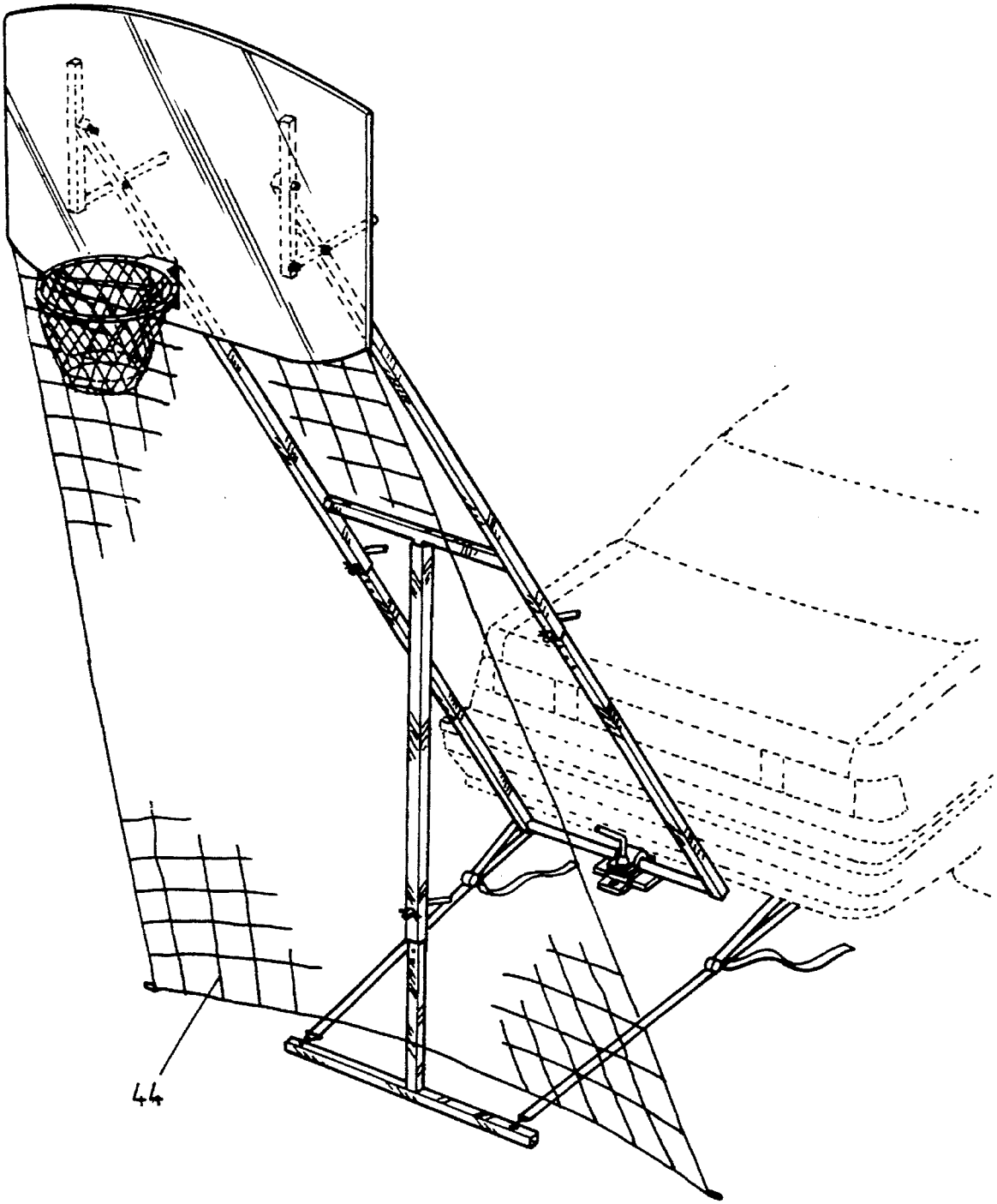
FIG. 11 shows the invention with the addition of a safety net.

Additionally, safety features may be included in the invention such as safety net 44 shown in FIG. 11 which can be attached to the backboard and the ground protection the vehicle from any misdirected balls. The various structural member may also be covered by soft or flexible materials to prevent injuries.

Whilst in the above embodiments the various structural members possessed particular geometries and arrangements this may also be varied. The various extensions and arms may have circular, triangular or other cross-sections, Furthermore the extension arms may be constructed so as to slide within the lower arms and not over as illustrated. This also applies to me other extension arrangements.

We claim:

1. A portable collapsible ball ring assembly used with a vehicle including;

an extendible main support frame rotatably attached to said vehicle;

an extendible secondary support frame rotatably attached to the main support frame and adapted to provide ground engaging base support for said main support frame when in an extended position;

and a ball ring rotatably attached to the main support frame;

wherein said assembly is foldable and collapsible into a storage position to form a compact structure while still attached to the vehicle without engaging the ground and;

wherein said assembly maybe unfolded and extended into a playing position whereby the assembly holds and supports said ball ring with the secondary support frame providing ground support allowing one to use said ball ring to play various sports such as basketball or netball.

2. The portable collapsible ball ring assembly of claim 1 further including a backboard for the ball ring so that the ball ring is a basketball goal.

3. The portable collapsible ball ring assembly of claim 2 wherein the basketball goal is rotatably attached to the main support frame by a bracket means.

4. The portable collapsible ball ring assembly of claim 1 wherein the vehicle comprises a rear tow bar and the main support frame is attached to the rear tow bar of the vehicle.

5. The portable collapsible ball ring assembly of claim 4 wherein the main support frame includes a lower bar substantially perpendicular to the main support frame, the lower bar securably attachable to the tow bar by a clamp means.

6. The portable collapsible ball ring assembly of claim 5 wherein the lower bar includes several apertures which are adapted to be alignable with apertures in the tow bar when the portable ball ring is in its transportable mode.

7. The portable collapsible ball ring assembly of claim 1 wherein the main support frame includes at least one lower arm and at least one extendable arm the at least one extendable arm slidably engaging the at least one lower arm to allow for the extension of the main support frame, the relative position of the at least one extendable arm to the at least one lower arm being secured by a locking means.

8. The portable collapsible ball ring assembly of claim 7 wherein the locking means is a pin engaging the at least one extendable arm and the at least one lower arm through co-axial apertures.

9. The portable collapsible ball ring assembly of claim 7 wherein when in the storage position the main support frame and the secondary support frame are substantially vertical to the ground and of minimum extension as allowed by the extendable arms slidably engaging the lower arms.

10. The portable collapsible ball ring assembly of claim 1 wherein the secondary support frame includes a horizontal extrusion to provide ground engaging base support for the main support frame.

11. The portable collapsible ball ring assembly of claim 9 wherein at least one strap is adapted to be attached to the horizontal extrusion and to the vehicle at any suitable position so as to provide support for said horizontal extrusion.

12. The portable collapsible ball ring assembly of claim 1 wherein the secondary support frame includes a lower arm and an extendable arm, the extendable arm slidably engaging the lower arm to allow for the extension of the secondary support frame, the relative position of the lower arm to the extension arm being secured by a locking means.

13. The portable collapsible ball ring assembly of claim 1 further including a net located between the ball ring and the vehicle to prevent a ball impacting on the vehicle.

14. The portable ball ring of claim 1 wherein the portable ball ring is adapted to be detachable from the vehicle and attachable to a wall or frame.

* * * * *